US007945200B2

(12) United States Patent
Norris et al.

(10) Patent No.: US 7,945,200 B2
(45) Date of Patent: May 17, 2011

(54) SYSTEMS AND METHODS FOR REMANUFACTURING IMAGING COMPONENTS

(75) Inventors: Jeffrey Ray Norris, Sanford, NC (US); Lawrence Dale Lewis, Sanford, NC (US)

(73) Assignee: Static Control Components, Inc., Sanford, NC (US)

( * ) Notice: Subject to any disclaimer, the term of this patent is extended or adjusted under 35 U.S.C. 154(b) by 222 days.

(21) Appl. No.: 11/904,396

(22) Filed: Sep. 27, 2007

(65) Prior Publication Data

US 2009/0087217 A1 Apr. 2, 2009

(51) Int. Cl.
*G03G 21/00* (2006.01)

(52) U.S. Cl. ..... 399/351; 399/109; 399/123

(58) Field of Classification Search ..... 399/109, 399/119, 260, 264, 274, 284, 123, 343, 350, 399/351

See application file for complete search history.

(56) References Cited

U.S. PATENT DOCUMENTS 4,841,332 A * 6/1989 Haneda et al. ..... 399/270
2005/0008401 A1 1/2005 Kawamura et al.
2005/0254862 A1 11/2005 Toba

* cited by examiner

*Primary Examiner* — David P Porta
*Assistant Examiner* — Benjamin Schmitt

(57) ABSTRACT

Systems and methods of remanufacturing an imaging cartridge include providing the imaging cartridge comprising a developer material supplying roller, a developer roller, a developer blade which regulates a layer of thickness of the developer material on the outer surface of the developer roller, the developer blade held in a first position to exert a first pressure on the outer surface of the developer roller, providing a replacement developer material having a set of characteristics, and adjusting the position of the developer blade to a second position to exert a second pressure on the outer surface of the developer roller, the second position of the developer blade selected to function with the replacement developer material having the set of characteristics.

6 Claims, 8 Drawing Sheets

SYSTEMS AND METHODS FOR REMANUFACTURING IMAGING COMPONENTS

BACKGROUND

The present invention generally relates to manufacturing, remanufacturing or repairing replaceable imaging components, and more particularly to apparatus and techniques for adjusting the imaging characteristics of a replaceable imaging cartridge adapted for holding marking material.

In the imaging industry, there is a growing market for the remanufacture and refurbishing of various types of replaceable imaging cartridges such as toner cartridges, drum cartridges, inkjet cartridges, and the like. These imaging cartridges are used in imaging devices such as laser printers, xerographic copiers, inkjet printers, facsimile machines and the like, for example. Imaging cartridges, once spent, are unusable for their originally intended purpose. Without a refurbishing process these cartridges would simply be discarded, even though the cartridge itself may still have potential life. As a result, techniques have been developed specifically to address this issue. These processes may entail, for example, the disassembly of the various structures of the cartridge, replacing toner or ink, cleaning, adjusting or replacing any worn components and reassembling the imaging cartridge.

SUMMARY

In one aspect of the present invention a method of remanufacturing an imaging cartridge includes providing the imaging cartridge comprising a developer material supplying roller and a developer roller, the developer material supplying roller for supplying developer material to the outer surface of the developer roller, the imaging cartridge further comprising a developer blade which regulates a layer of thickness of the developer material on the outer surface of the developer roller, the developer blade held in a first position to exert a first pressure on the outer surface of the developer roller, the imaging cartridge further comprising a photosensitive drum rotatably held in a fixed position with respect to the developer roller and adapted for receiving a portion of the developer material from the surface of the developer roller as the photosensitive drum and the developer roller rotate; providing a replacement developer material having a set of characteristics; and adjusting the position of the developer blade to a second position to exert a second pressure on the outer surface of the developer roller, the second position of the developer blade selected to function with the replacement developer material having the first set of characteristics, wherein the second pressure exerted on the outer surface of the developer roller by the developer blade is a different pressure from the first pressure exerted on the outer surface of the developer roller by the developer blade.

In another aspect of the present invention, a remanufactured imaging cartridge includes a developer material supplying roller and a developer roller, the developer material supplying roller for supplying developer material to the outer surface of the developer roller; a developer blade which regulates a layer of thickness of the developer material on the outer surface of the developer roller; a developer blade mounting bracket holding the developer blade; a developer blade spacing member disposed between the developer blade mounting bracket and a portion of the imaging cartridge, the thickness of the developer blade spacing member selected to determine the lateral position of the developer blade; a photosensitive drum rotatably held in a fixed position with respect to the developer roller and adapted for receiving a portion of the developer material from the surface of the developer roller as the photosensitive drum and the developer roller rotate; and a replacement developer material having a set of characteristics, the position of the developer blade adjusted to exert a pressure on the outer surface of the developer roller, the position of the developer blade selected to function with the replacement developer material having the set of characteristics.

In another aspect of the present invention, a method of remanufacturing an imaging cartridge having a developer frame includes providing a developer blade mounting bracket holding a developer blade, the developer blade comprising a first positioning member and a second positioning member, the first positioning member disposed at a substantially right angle with respect to the second positioning member; providing a spacer; and attaching the developer blade mounting bracket to the developer frame of the imaging cartridge, the spacer disposed between the developer blade mounting bracket and the developer frame. The method may include attaching the spacer to the developer blade mounting bracket. The spacer may attached to the first positioning member of the developer blade mounting bracket. The spacer may be disposed between the developer frame and the second positioning member of the developer blade mounting bracket. The method may include attaching the spacer to the developer frame. The spacer may be disposed between the developer frame and the second positioning member of the developer blade mounting bracket. The spacer may disposed between the developer frame and the first positioning member of the developer blade mounting bracket.

A more complete understanding of the present invention, as well as further features and advantages of the invention, will be apparent from the following detailed description and the accompanying drawings.

DETAILED DESCRIPTION

The following detailed description of preferred embodiments refers to the accompanying drawings which illustrate specific embodiments of the invention. In the discussion that follows, specific systems and techniques for repairing, manufacturing or remanufacturing a toner cartridge, such as an HP 2600 toner cartridge, are disclosed. Other embodiments having different structures and operations for the repair, remanufacture and operation of other types of replaceable imaging components and for various types of imaging devices, such as laser printers, inkjet printers, copiers, facsimile machines and the like, do not depart from the scope of the present invention.

Figure 1:
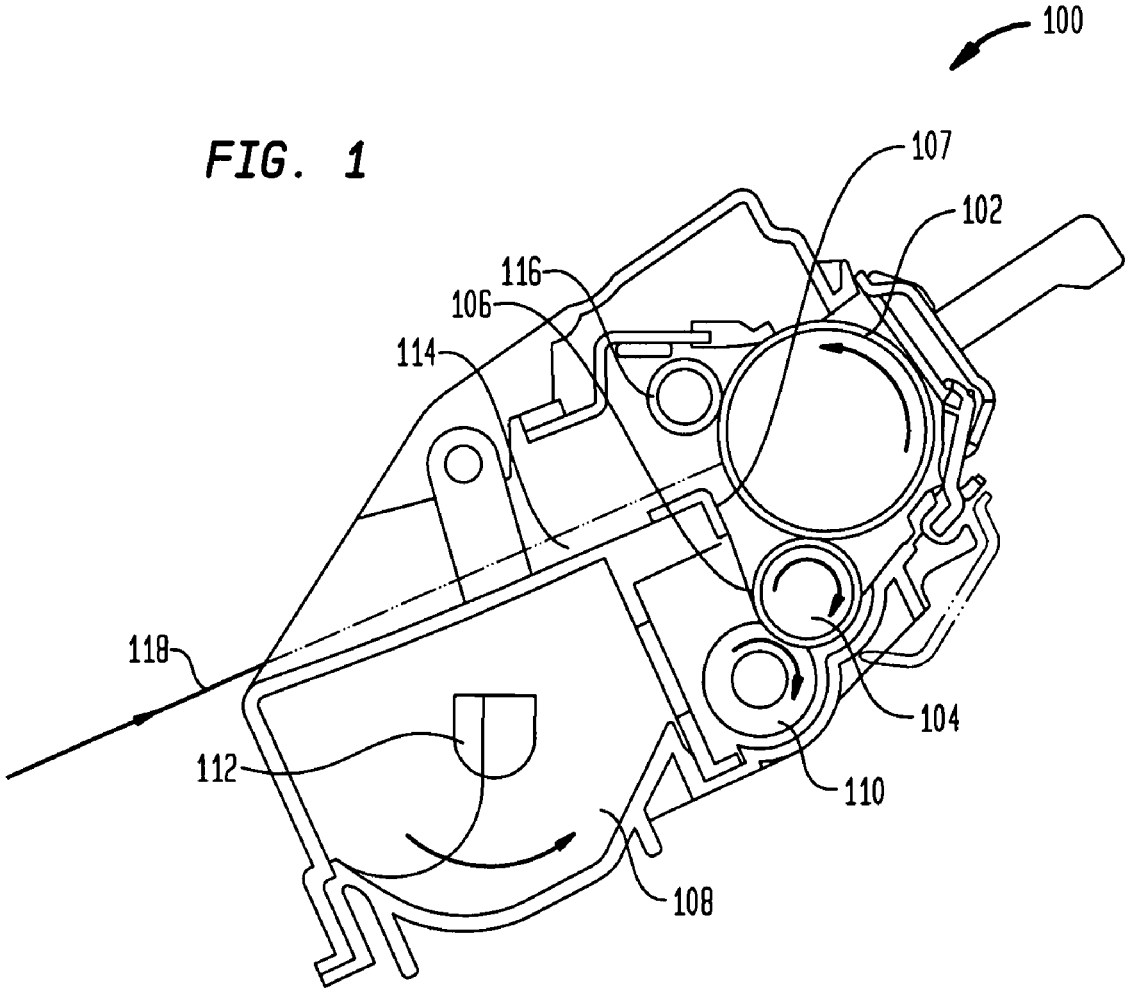
FIG. 1 shows a cross-sectional view of an exemplary imaging cartridge in accordance with the present invention.

FIG. 1 shows a cross-sectional view of an exemplary imaging cartridge 100. The imaging cartridge comprises a photosensitive drum 102, a developer roller 104, a developer blade 106, a hopper 108 for holding developer material and a developer material supplying roller 110. During operation of the imaging cartridge 100, developer material is moved by an agitator 112 from the hopper 108 to the developer material supplying roller 110 which deposits the developer material on the surface of the developer roller 104. The developer blade 106 is attached to a developer blade mounting bracket 107 which is secured to a developer frame 114. The developer blade 106 is thus against the rotating developer roller 104 and, as the developer roller 104 rotates, regulates the amount of developer material deposited on the surface of the developer roller 104. As the photosensitive drum 102 is rotated, it is uniformly charged to a predetermined polarity and a predetermined potential by a charging device 116. A laser beam 118 then forms an electrostatic latent image on the photosensitive drum 102. When developer material on the surface of the developer roller 102 is rotated to an area near the photosensitive drum 102, some of the developer material moves to the charged area of the photosensitive drum 102 and develops the electrostatic latent image.

Figure 2:
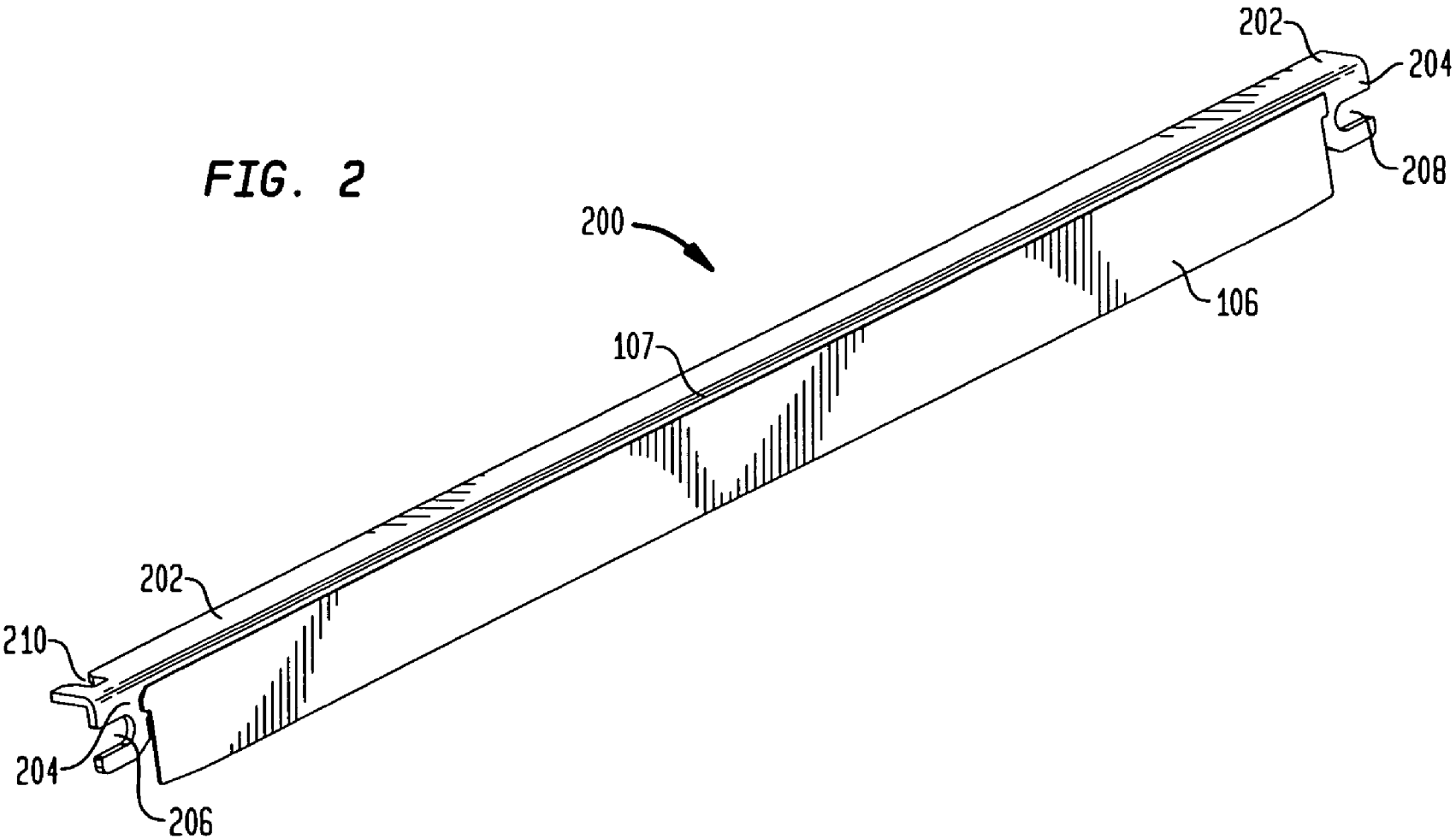
FIG. 2 shows a perspective view of an exemplary developer blade assembly.

FIG. 2 shows a perspective view of an exemplary developer blade assembly 200. The developer blade assembly 200 comprises the developer blade 106 attached to the developer blade mounting bracket 107. The developer blade mounting bracket 107 may include a first positioning member 202 and a second positioning member 204. In one aspect of the present invention, as shown in FIG. 2, the developer blade mounting bracket 107 is shaped in a substantially L-shaped configuration, with the first positioning member 202 and the second positioning member 204 disposed at right angles with respect to each other. Slots 206 and 208 are disposed on a left end and a right end, respectively, of the second positioning member 204 of the developer blade mounting bracket 107. A notch 210 is disposed on the left end of the first positioning member 202 of the developer blade mounting bracket 107.

Figure 3:
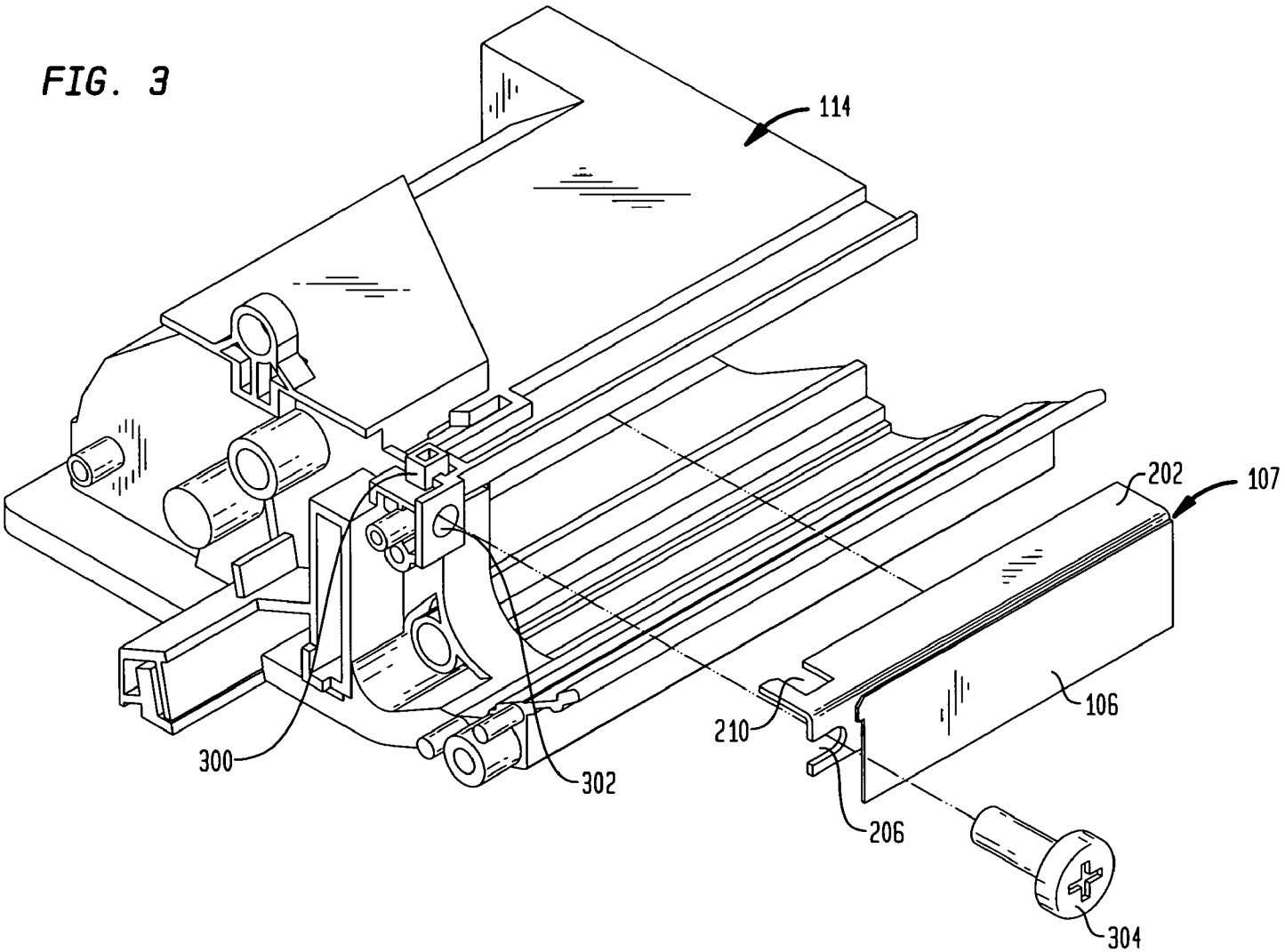
FIG. 3 shows a cross-sectional perspective view of a left side of the developer blade assembly and a portion of the developer frame.
Figure 4:
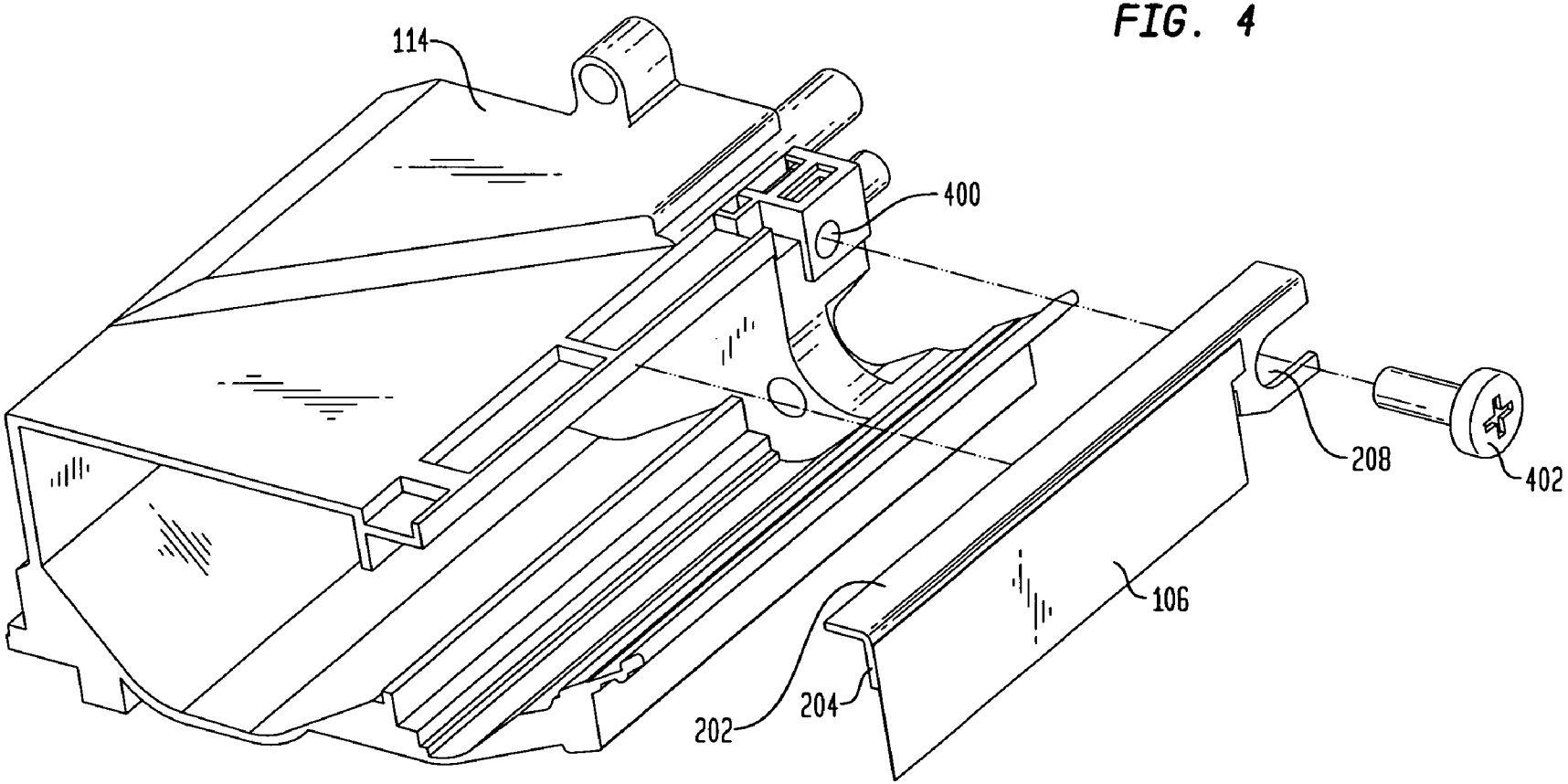
FIG. 4 shows a cross-sectional perspective view of a right side of the developer blade assembly and a portion of the developer frame.

FIGS. 3 and 4 show cross-sectional exploded perspective views of a left end and a right end, respectively, of the developer blade assembly 200 and a portion of the developer frame 114. As shown in FIG. 3, when the developer blade assembly 200 is attached to the developer frame 114, the notch 210 engages a protrusion 300 of the developer frame 114. The slot 206 aligns with a hole 302 and allows a screw 304 to be inserted through the slot 206 and into the hole 302, thus securing the left end of the developer blade assembly 200 to the developer frame 114. As shown in FIG. 4, the slot 208 aligns with a hole 400 and allows a screw 402 to be inserted through the slot 208 and into the hole 400, thus securing the right end of the developer blade assembly to the developer frame 114.

Figure 5:
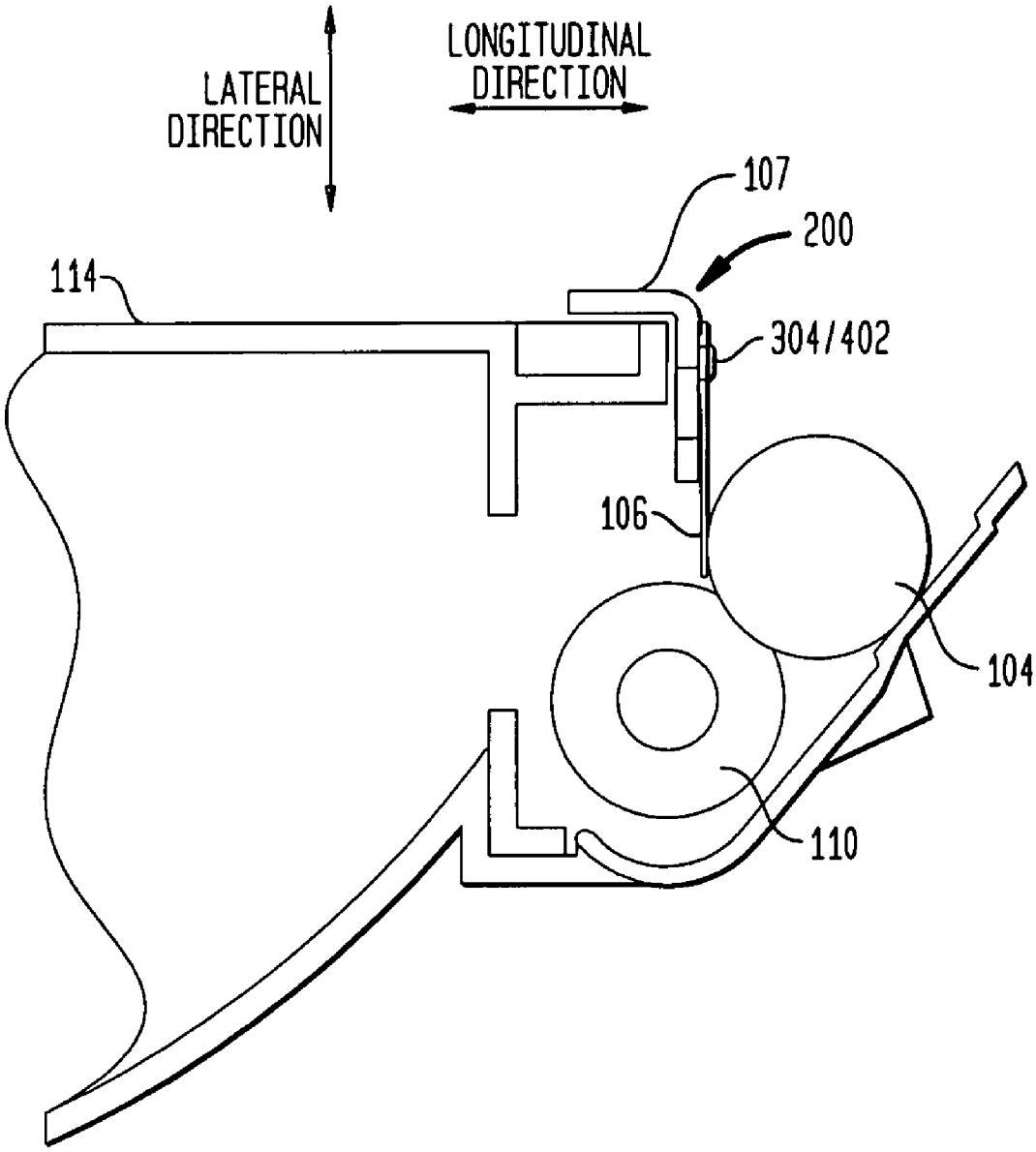
FIG. 5 shows a cross-sectional view of a portion of the imaging cartridge.

As the widths of the slots 206 and 208 are greater the diameters of the screws 304 and 402, respectively, the lateral position of the developer blade assembly 200 may be advantageously adjusted (while remanufacturing the imaging cartridge 100) to a desired location before the screws 304 and 402 are tightened. Such adjustment may affect the pressure the developer blade 106 applies to the developer roller 104, which will in turn affect various imaging characteristics of the imaging cartridge 100, such as increasing or decreasing background and print density, for example. Such adjustment may be advantageous to improve printing performance when using replacement toner which has different characteristics from the toner originally used in the imaging cartridge. Alternatively, or in addition to, the longitudinal position of the developer blade assembly 200 may also be adjusted to affect the imaging characteristics. FIG. 5 shows a cross-sectional view of a portion of the imaging cartridge 100 in accordance with the present invention and the lateral and longitudinal directions in which the developer blade assembly 200 may be adjusted.

Figure 6:
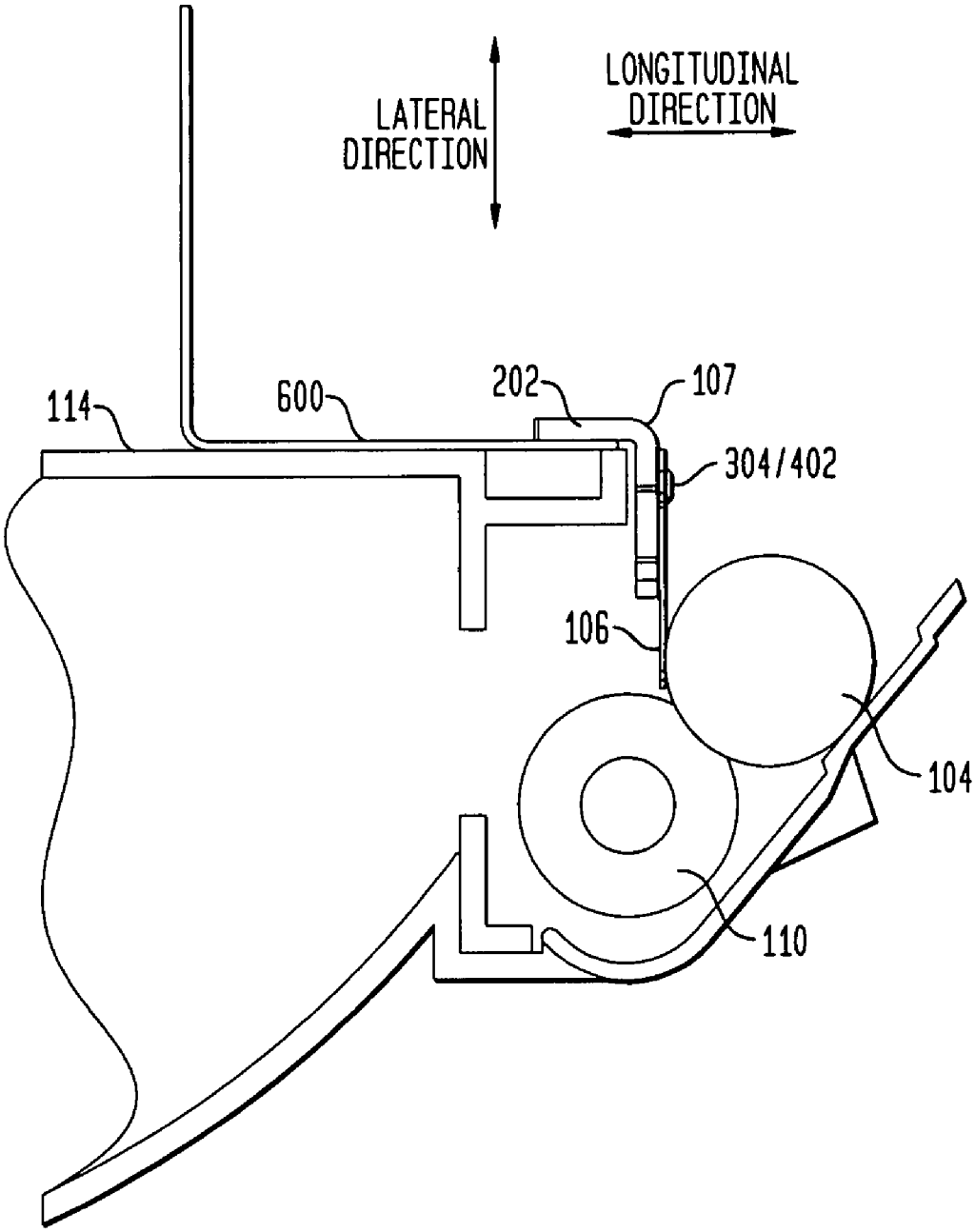
FIG. 6 shows a cross-sectional view of a portion of the imaging cartridge in accordance with the present invention.

As shown in FIG. 6, an adjustment tool 600 may be utilized to select a particular lateral position for the developer blade 106. Before the screws 304 and 402 are fully tightened to secure the developer blade assembly 200 to the developer frame 114, the adjustment tool 600 may be inserted between the first positioning member 202 and a portion of the developer frame 114. While the first positioning member 202 is firmly pressed against the adjustment tool 600, the screws 304 and 402 may then be tightened, securing the developer blade assembly 200 in place. The adjustment tool 600 may then be removed. The thickness of the adjustment tool 600 may be selected to ensure the proper lateral positioning of the developer blade assembly 200. A thinner adjustment tool 600 lowers the developer blade 106, increasing the pressure of the developer blade 106 against the developer roller 104. Conversely, a thicker adjustment tool 600 raises the developer blade 106, decreasing the pressure of the developer blade 106 against the developer roller 104. In one aspect of the present invention, to determine an appropriate lateral positioning of the developer blade assembly 200, a variety a lateral positions may be tried with a particular developer material and the printing results analyzed to select the lateral position which provides optimum or desired imaging results.

Figure 7:
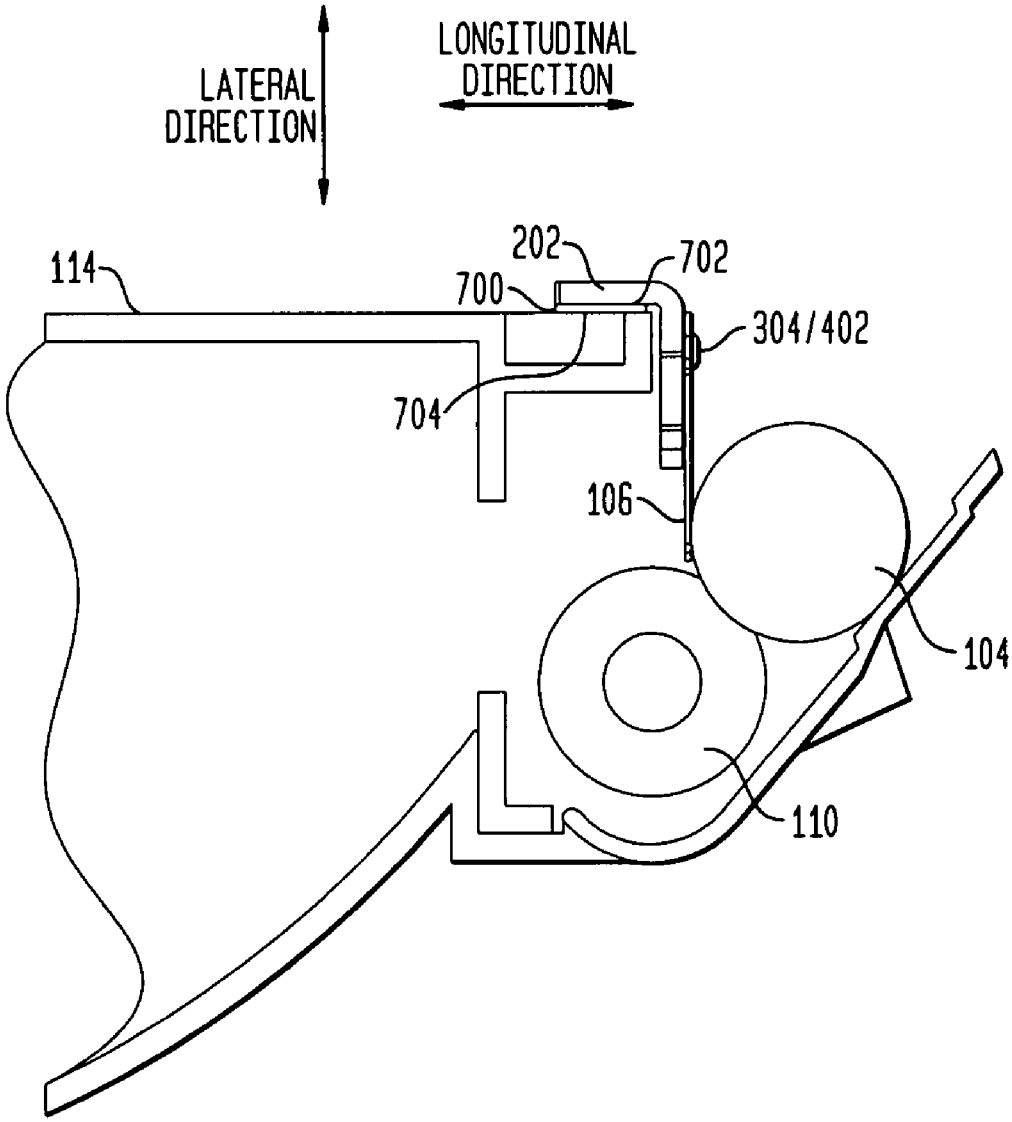
FIG. 7 shows a cross-sectional view of a portion of the imaging cartridge in accordance with another aspect of the present invention.

As shown in FIG. 7, in another aspect of the present invention, a spacer strip 700 may be disposed between the first positioning member 202 and a portion of the developer frame 114 to position the developer blade assembly 200. The spacer strip 700 may include either or both adhesive layers 702 and 704 on opposing sides of the spacer strip 700 to securely adhere the first positioning member 202 in place prior to the screws 304 and 402 being fully tightened. The spacer strip 700 may suitably comprise high impact polystyrene (HIPS), metal, plastic or other suitable material.

Figure 8:
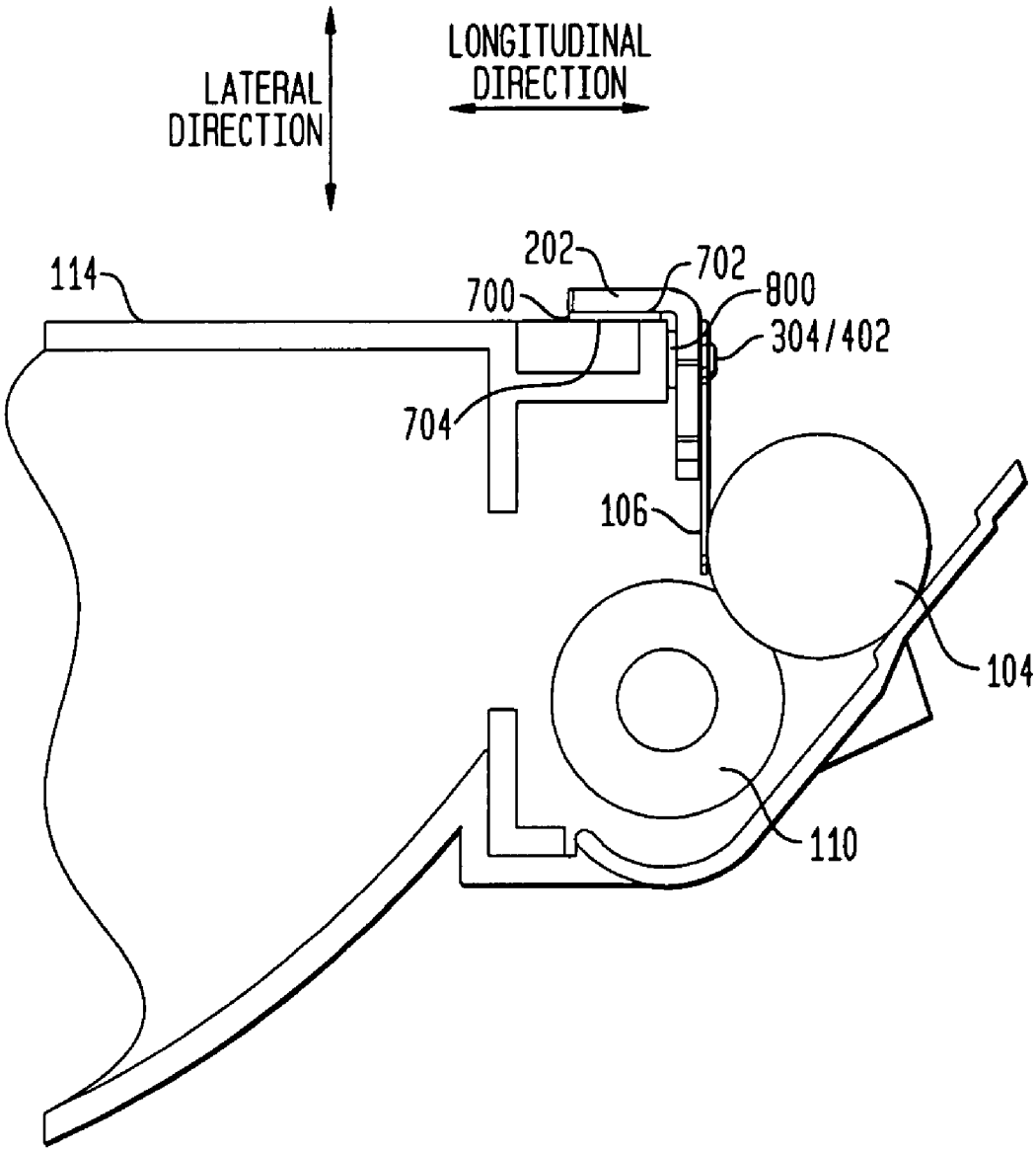
FIG. 8 shows a cross-sectional view of a portion of the imaging cartridge in accordance with another aspect of the present invention.

In another aspect of the present invention, the longitudinal position of the developer blade assembly 200 may also be adjusted to affect the imaging characteristics. As shown in FIG. 8, a spacer 800 may be disposed between the second positioning member 204 and the developer frame 114. A thinner spacer 800 increases the pressure of the developer blade 106 against the developer roller 104. Conversely, a thicker spacer 800 decreases the pressure of the developer blade 104 against the developer roller 104. The thickness of the spacer 800 may be selected to provide optimum or desired imaging results. The spacer 800 may be attached to the developer frame 114 or the second positioning member 204 with an adhesive.

In another aspect of the present invention, as the lateral position of the developer blade 106 is adjusted, an unworn section of the developer blade 106 may be placed in contact with the developer roller 104. During use of the imaging cartridge 100, a section of the developer blade 106 is worn slightly due to the frictional contact with the developer roller 104. When the imaging cartridge 100 is remanufactured, moving the developer blade 106 to a new position may bring an unworn section of the developer blade 106 in contact with the developer roller 104. Having an unworn section of the developer blade 106 in contact with the developer roller 104 may increase the pressure the developer blade 106 applies to the developer roller 104 and may affect various imaging characteristics of the imaging cartridge 100, such as increasing or decreasing backgrounding and print density, for example.

Although specific embodiments have been illustrated and described herein, those of ordinary skill in the art appreciate that any arrangement that is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

What is claimed is:

1. A method of remanufacturing an imaging cartridge comprising:

providing the imaging cartridge comprising a developer material supplying roller and a developer roller, the developer material supplying roller for supplying developer material to the outer surface of the developer roller, the imaging cartridge further comprising a developer blade which regulates a layer of thickness of the developer material on the outer surface of the developer roller, the developer blade held in a first position to exert a first pressure on the outer surface of the developer roller, the imaging cartridge further comprising a photosensitive drum rotatably held in a fixed position with respect to the developer roller and adapted for receiving a portion of the developer material from the surface of the developer roller as the photosensitive drum and the developer roller rotate;

providing a replacement developer material having a set of characteristics; and adjusting the position of the developer blade to a second position to exert a second pressure on the outer surface of the developer roller, the second position of the developer blade selected to function with the replacement developer material having the set of characteristics, wherein the second pressure exerted on the outer surface of the developer roller by the developer blade is a different pressure from the first pressure exerted on the outer surface of the developer roller by the developer blade, wherein the imaging cartridge further comprises a developer blade mounting bracket, the method further comprising:

disposing a spacing member between the developer blade mounting bracket and a portion of the imaging cartridge, the thickness of the spacing member is selected to position the developer blade in the second position to exert the second pressure on the outer surface of the developer roller.

2. The method of claim 1 wherein the spacing member is attached to the developer blade mounting bracket.

3. The method of claim 1 wherein the spacing member is attached to the imaging cartridge.

4. The method of claim l wherein the portion of the imaging cartridge comprises a developer frame.

5. The method of claim l wherein the thickness of the spacing member is selected to control the position of the developer blade to reduce backgrounding.

6. The method of claim l wherein the thickness of the spacing member is selected to control the position of the developer blade to increase print density.

* * * * *